US009338562B2

(12) United States Patent
Elmedyb et al.

(10) Patent No.: US 9,338,562 B2
(45) Date of Patent: May 10, 2016

(54) LISTENING SYSTEM WITH AN IMPROVED FEEDBACK CANCELLATION SYSTEM, A METHOD AND USE

(71) Applicant: Oticon A/S, Smorum (DK)

(72) Inventors: Thomas Bo Elmedyb, Smorum (DK); Johan Hellgren, Linkoping (SE)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/315,115

(22) Filed: Jun. 25, 2014

(65) Prior Publication Data

US 2014/0355802 A1 Dec. 4, 2014

Related U.S. Application Data

(62) Division of application No. 12/363,183, filed on Jan. 30, 2009, now Pat. No. 8,798,297.

(30) Foreign Application Priority Data

Feb. 1, 2008 (EP) ..... 08101215

(51) Int. Cl.
*H04R 25/00* (2006.01)
*H04R 3/00* (2006.01)

(52) U.S. Cl.
CPC ..... *H04R 25/453* (2013.01); *H04R 3/002* (2013.01)

(58) Field of Classification Search
CPC ..... H04R 3/00; H04R 3/02; H04R 5/00; H04R 5/453; H04B 3/23
See application file for complete search history.

(56) References Cited

U.S. PATENT DOCUMENTS 5,202,927 A 4/1993 Topholm
5,402,496 A 3/1995 Soli et al.
(Continued)

FOREIGN PATENT DOCUMENTS

EP 1 460 769 A1 9/2004
WO WO 01/06746 A2 1/2001
(Continued)

OTHER PUBLICATIONS

Haykin, "Adaptive Filter Theory", Prentice Hall, 3rd edition, Ch. 6, "Linear Prediction" pp. 241-301 (1996).
(Continued)

*Primary Examiner* — Kenneth Parker
*Assistant Examiner* — Fang-Xing Jiang
(74) *Attorney, Agent, or Firm* — Birch, Stewart, Kolasch & Birch, LLP

(57) ABSTRACT

A listening device includes an input transducer, an output transducer, a signal processor, and a feedback cancellation system for estimating acoustic feedback. The feedback cancellation system includes an adaptive FBC filter arranged in parallel to the forward path, an adaptive whitening filter, and a howl detection unit that performs howl detection based on an output of the adaptive whitening filter. The adaptive FBC filter includes a variable FBC filter part and an FBC update algorithm part for updating the variable FBC filter part, the FBC update algorithm part receiving first and second FBC algorithm input signals influenced by the electrical input and the electrical output signals. Further, the feedback cancellation system receives an electrical update signal essentially consisting of the direct part of the electrical input signal and coefficients of the adaptive whitening filter are based on the electrical update signal.

18 Claims, 7 Drawing Sheets

(56) References Cited

U.S. PATENT DOCUMENTS

| | | | | |
|---|---|---|---|---|
| 5,442,712 | A * | 8/1995 | Kawamura et al. | 381/83 |
| 6,868,157 | B1 * | 3/2005 | Okuda | H04B 3/23 379/406.01 |
| 2002/0176594 | A1 * | 11/2002 | Hohmann et al. | 381/312 |
| 2003/0053647 | A1 * | 3/2003 | Kates | 381/318 |
| 2006/0291681 | A1 | 12/2006 | Klinkby et al. | |
| 2008/0063228 | A1 | 3/2008 | Mejia et al. | |
| 2009/0067651 | A1 * | 3/2009 | Klinkby | H04R 25/453 381/313 |
| 2010/0020979 | A1 * | 1/2010 | Elmedyb | H04R 25/453 381/60 |
| 2010/0202641 | A1 * | 8/2010 | Guo | H04R 25/453 381/318 |

FOREIGN PATENT DOCUMENTS

| | | | |
|---|---|---|---|
| WO | WO 2005/096670 | A1 | 10/2005 |
| WO | WO 2007/113282 | A1 | 10/2007 |
| WO | WO 2007/125132 | A2 | 11/2007 |

OTHER PUBLICATIONS

Johan Hellgren., "Analysis of Feedback Cancellation in Hearing Aids with Filtered-X LMS and the Direct Method of Closed Loop Identification", IEEE Transactions on Speech and Audio Processing, vol. 10, No. 2; pp. 119-131 (2002).

Sayed, "Fundamentals of Adaptive Filtering", John Wiley & Sons, pp. 212-280 (2003).

Spriet et al., "Adaptive Feedback Cancellation in Hearing Aids with Liner Prediction of the Desired Signal", IEEE Transactions on Signal Processing, vol. 53, No. 10, pp. 3749-3763 (2005).

* cited by examiner

LISTENING SYSTEM WITH AN IMPROVED FEEDBACK CANCELLATION SYSTEM, A METHOD AND USE

This application is a Divisional of co-pending application Ser. No. 12/363,183, filed on Jan. 30, 2009, and for which priority is claimed under 35 U.S.C. §120. This application claims priority of EP Application No. 08101215.5, filed on Feb. 1, 2008 under 35 U.S.C. §119; the entire contents of all are hereby incorporated by reference.

TECHNICAL FIELD

The present invention relates to listening systems (e.g. a hearing aid system) with active feedback cancellation. The invention relates specifically to a listening system comprising a first input transducer for converting an input sound to an electrical input signal, the electrical input signal comprising a direct part and an acoustic feedback part, an output transducer for converting an electrical output signal to an output sound, a forward path being defined between the input and output transducer, and a feedback cancellation (FBC) system for estimating acoustic feedback from the output to the input transducer, the FBC system comprising an adaptive FBC filter arranged in parallel to the forward path.

The invention furthermore relates to a method of improving feedback cancellation in a listening system and to the use of a hearing aid system.

The invention may e.g. be useful in listening devices comprising active feedback cancellation, e.g. hearing aids, active ear protection devices, etc.

BACKGROUND ART

The following account of the prior art relates to one of the areas of application of the present invention, hearing aids.

In hearing aids (HA) with feedback cancellation, an adaptive filter can be used to estimate the part of the microphone signal that is due to feedback from the receiver (the signal path from the receiver to the microphone is typically termed the acoustic feedback path). The estimated signal is subtracted from the microphone input signal and the feedback is cancelled, if the adaptive filter has the same characteristics as the acoustic feedback path. There are several methods to update the adaptive filter. One commonly used method is to use the output signal as reference signal and the residual signal after cancellation as the error signal, and use these signals together with an update method of the filter coefficients that minimizes the energy of the error signal, e.g. a least means squared (LMS) algorithm, cf. FIG. 1*a*. This arrangement is termed 'the direct method of closed loop identification'. A benefit of the direct method is that a probe noise is not necessary and that the level of the reference signal will be higher than if a probe noise is used. The drawback is that the estimate of the acoustic feedback path (provided by the adaptive filter) will be biased, if the input signal to the system is not white (i.e. if there is autocorrelation) or if improper whitening is used. This means that the anti feedback system may introduce artefacts when there is autocorrelation (e.g. tones) in the input.

The term 'white' in connection with acoustical or electrical signals is taken to mean that the signal has a substantially flat power spectrum in the frequency range of consideration.

Whitening can be used to avoid these artefacts. This is done by filtering both reference signal and error signal with a filter that makes the input signal without feedback component white. This filter should change with the spectrum of the input signal. Therefore it should be adaptive. Adaptive whitening is described by Spriet et al. in the paper "Adaptive feedback cancellation in hearing aids with linear prediction of the desired signal". In this paper, the feedback cancellation is based on signals of the hearing aid, which does not enable the distinguishing of desired external tones and oscillations due to feedback.

DISCLOSURE OF INVENTION

A problem is that the whitening filter should whiten the input signal as it is before the acoustic feedback is added and this signal is not available. If the whitening filter is adjusted so that it whitens the microphone signal, then oscillation due to feedback will be removed from the reference signal and error signal and the feedback cancellation filter will not be updated to remove the oscillation.

The object of the present invention is to provide an alternative scheme for improving acoustic feedback cancellation.

The present invention relates to a listening system, e.g. a hearing aid system, with an anti feedback system, where a variable filter (e.g. a whitening filter) is estimated based on a signal where acoustic feedback is minimized or at least different (e.g. in a contra lateral hearing instrument of a binaural hearing aid system) and used to avoid artefacts that tonal inputs otherwise may give. The invention further relates to a method of improving feedback cancellation and to the use of a listening system. A variable filter is in the present context understood to be an electrical filter, whose transfer function can be dynamically updated (e.g. by an algorithm). A whitening filter in the present context understood to be an electrical filter, which converts a given signal to a signal with a substantially flat power spectrum (when the input signal does not contain a howl, e.g. when loop gain is less than −2 dB or less than −5 dB or less than −10 db). An adaptive filter is an example of a variable filter. A whitening filter can be based on a variable filter (e.g. an adaptive filter).

The term 'a listening system' comprises an audio system comprising a number of listening devices (such as one or two or more, typically one or two listening device adapted for being worn in full or partially in or at a left and/or right ear of a wearer). The term 'a listening device' comprises a hearing instrument, a headset, a head phone, an ear-plug, etc. The term 'a listening system' includes a pair of hearing instruments of a binaural fitting and a pair of head phones and a pair of active ear-plugs and combinations thereof (e.g. headphones or headsets or ear-plugs that also have a hearing instrument function or one head phone and one hearing instrument, etc.).

The term a 'hearing instrument' is in the present context taken to mean a hearing aid comprising a signal processor whose gain profile (gain vs. frequency) can be (or has been) adapted to a specific wearer's needs to compensate for a hearing loss.

The term 'a flat power spectrum' is taken to mean a power spectrum, for which the variation of the power level with frequency in the frequency range or band of interest is much smaller than the average value of the power level over the frequency range or frequency band in question. The frequency range of interest $\Delta f$ is e.g. between 5 Hz and 20 kHz, such as between 10 Hz and 10 kHz, possibly split into a number of frequency bands $FB_i$ ($i=1, 2, \ldots, q$), e.g. $q=8$ or 16 or 64 or more (where each band may be individually processed). The variation of the power level with frequency $\Delta P$ may e.g. be taken as the difference between the maximum $P(\Delta f)_{max}$ and minimum $P(\Delta f)_{min}$ values over the frequency range of interest $\Delta f$ (or between $P(FB_i)_{max}$ and $P(FB_i)_{min}$ over the frequency band $FB_i$ of interest). In an embodiment, the variation of the power level with frequency is less than 30% of the average value of the power level $P_{avg}(\Delta f)$ over the frequency range of interest (or of the average value of the power level $P_{avg}(FB_i)$ over the frequency band of interest), such as less than 20%, such as less than 10%, such as less than 5%, such as less than 2%.

In a specific listening device comprising an input transducer and an output transducer and a signal path there between and the signal path comprising an amplifying element (e.g. a signal processor), it is important to minimize the acoustical feedback from the output to the input transducer. It is assumed that for the particular listening device (at a particular spatial location at a given time), the input signal comprises a direct part (i.e. the 'target signal' that is intended to be processed and forwarded to the wearer of the listening device) and an acoustic feedback part from the output to the input transducer of that particular listening device. The term 'estimated based on a signal where acoustic feedback is minimized or at least different' is to be understood as estimated based on a signal that does not contain significant contributions of the output signal from the output transducer of the listening device in question and contains a reasonable representation of the direct part of the input signal for the listening device in question (i.e. it contains the direct part of the input signal, possibly distorted with a known or assessable transfer function (e.g. attenuated equally over the frequency range or band in question), allowing a reconstruction of it).

A Listening System:

An object of the invention is achieved by a listening system comprising a first input transducer for converting an input sound to an electrical input signal, the electrical input signal comprising a direct part and an acoustic feedback part, an output transducer for converting an electrical output signal to an output sound, a forward path being defined between the input and output transducer and comprising a signal processing unit, a feedback cancellation system for estimating acoustic feedback comprising an adaptive FBC filter arranged in parallel to the forward path, the adaptive FBC filter comprising a variable FBC filter part and an FBC update algorithm part for updating the variable FBC filter part, the FBC update algorithm part comprising first and second FBC algorithm input signals influenced by the electrical input and output signals, respectively, the first and second FBC update algorithm input signal paths comprising first and second variable filters, respectively, the listening system further comprising an electrical update signal essentially consisting of said direct part of said electrical input signal, wherein said first and second variable filters are adapted to be updated on the basis of said electrical update signal.

An advantage of the invention is that a desired tone in the input signal is not substantially affected by the feedback cancellation system. A 'desired tone' is intended to mean a tone in the direct part of input signal ('the target signal), i.e. not originating from acoustic feedback.

The term 'adaptive FBC filter' is used in the present context to indicate the adaptive filter of the feedback cancellation system to distinguish it from possible other adaptive filters used elsewhere in the system.

In the present application, the acoustic input signal to the first input transducer as well as the electrical input signal converted there from are divided in a 'direct part' and an 'acoustic feedback part' ('the input signal as it is before the acoustic feedback is added' as referred to above thus constituting the 'direct part'). The 'direct' part of the acoustic input signal to the first input transducer thus consists of the combined signal from all other sources of acoustic signals than that from the output transducer of the listening device in question (i.e. than from the 'acoustic feedback part' of the signal).

The term 'on the basis of said electrical update signal' is taken to mean 'derived from' or 'influenced by said electrical update signal'. It is intended not to exclude that other signals can influence the result, e.g. in a part of the frequency range. The term 'wherein said first and second variable filters are adapted to be updated on the basis of said electrical update signal' is thus intended to mean that dynamic changes (updates) to filter coefficients of the first and second variable filters are calculated using a signal originating from the electrical update signal.

In an embodiment, the first and second variable filters are adapted to be updated in one frequency range on the basis of the electrical update signal and in another frequency range based on the electrical input signal or another signal.

In an embodiment, the first and second variable filters are adapted to be updated solely on the basis of the electrical update signal.

The forward path (often also termed the signal path) comprises a signal processor (signal processing unit). In an embodiment, the signal processor is adapted to allow a frequency dependent gain profile to be modified according to a specific wearer's needs, such as e.g. in a hearing instrument.

In a particular embodiment, the system further comprises a second input transducer spatially located relative to the first input transducer to generate the electrical signal (termed 'the electrical update signal') essentially consisting of the direct part of the electrical input signal. The term 'essentially consisting of the direct part' is in the present context taken to mean that the signal in question ('the electrical update signal)' comprises a smaller fraction of the acoustic feedback signal from the output to the input transducer of the listening device in question than the electrical input signal generated by the first input transducer of that listening device AND that it contains the direct part of the input signal or allows a reconstruction or approximation of it. In case the second input transducer forms part of another (second) listening device, such as a contra-lateral hearing instrument, the electrical update signal extracted from this second input transducer may contain acoustic feedback from an output transducer of the second listening device 'instead' of acoustic feedback from the output transducer of the first listening device for which the electrical update signal is to be used. Although not free of acoustic feedback, such signal is anyway better for the present purpose than the electrical input signal of the first listening device.

In an embodiment, the second input transducer (when the listening system is in operation) is located at a position where the acoustical signal from the output transducer at a given frequency (such as at essentially all relevant frequencies) is smaller than at the location of the first input transducer. Preferably, the sound level from the output transducer at the location of the second input transducer is 3 dB, such as 5 dB, such as 10 dB, such as 20 dB lower, such as 30 dB lower, such as 40 dB lower than at the first input transducer. In an embodiment, the second input transducer is located at a position where the acoustical signal from the output transducer at a given frequency or frequency range or band (such as at essentially all relevant frequencies or frequency bands) is smaller than at the location of the first input transducer. Preferably, the sound level from the output transducer at the location of the second input transducer is 3 dB, such as 5 dB, such as 10 dB, such as 20 dB lower, such as 30 dB lower, such as 40 dB lower than at the first input transducer.

In an embodiment, the listening system is adapted to be fully or partially body worn or capable of being body worn. In an embodiment, the first and second input transducers and the output transducer are located in the same physical body. In an embodiment, the listening system comprises at least two physically separate bodies (such as the first, second and third bodies mentioned in the following), which are capable of being in communication with each other by wired or wireless transmission (be it acoustic, ultrasonic, electrical of optical). In an embodiment, the first input transducer is located in a first body and the second input transducer in a second body of the listening system. In an embodiment, the first input transducer is located in a first body together with the output transducer and the second input transducer is located in a second body. In an embodiment, the first input transducer is located in a first body and the output transducer is located in a second body. In an embodiment, the second input transducer is located in a third body.

The term 'two physically separate bodies' is in the present context taken to mean two bodies that have separate physical housings, possibly not mechanically connected or alternatively only connected by one or more guides for acoustical, electrical or optical propagation of signals.

In an embodiment, the first input transducer is part of a first listening device comprising the forward path, the adaptive FBC-filter and the output transducer. In an embodiment, the first listening device may comprise at least two physically separate bodies.

In an embodiment, an input transducer is a microphone. In an embodiment, an output transducer is a speaker (also termed a receiver).

In an embodiment, a physical body forming part of a listening device comprises more than one microphone, such as two microphones or more than two microphones, e.g. a number of microphones arranged in an array (e.g. to improve the extraction of directional information of the acoustic signal relative to the physical body in question).

In a particular embodiment, the listening system comprises first and second listening devices, one for each ear of a wearer, wherein the first input transducer forms part of the first listening device, and the second input transducer is an input transducer of the second listening device.

In an embodiment, the second input transducer is a microphone of a mobile telephone or some other communications device (e.g. a remote control unit for the listening system or a body worn audio selection device) being able to communicate, by wire or wirelessly, with the listening device comprising the first input transducer. In an embodiment, the listening system is adapted so that the other communications device can communicate with the listening device comprising the first input transducer via a wireless communications standard, e.g. BlueTooth. In an embodiment the communication is based on inductive coupling.

In an embodiment, the listening system is adapted to provide that the update signal itself or filter coefficients based on the update signal is/are transmitted from the device wherein the second input transducer is located to the device where the first input transducer is located and used in the update process of the first and second variable filters. In an embodiment, only the filter coefficients are transmitted from one device to the other. In an embodiment, the transmission is performed according to a predefined scheme or is only performed when at least one filter coefficient has changed, e.g. more than 20%. This has the advantage of relaxing the requirements to the bandwidth of the wireless link, and to reduce the power consumption of the transceiver(s) of the wireless link substantially (compared to a continuous transmission of a full or partial audio signal).

In a preferred embodiment, the listening system is adapted to split the frequency range of interest of the electrical input signal into a number of bands, which can be processed separately. In an embodiment, the listening system comprises a filter bank splitting the electrical input signal into a number of signals, each comprising a particular frequency band $FB_i$ ($i=1, 2, \ldots, q$), where q can be any relevant number larger than 1, e.g. $2^n$, where n is an integer ≥1, e.g. 6. In a preferred embodiment, the listening system is adapted to estimate feedback in each frequency band or in a number of frequency bands, e.g. separately located or located together, e.g. assemblies of frequency bands comprising the relatively lower part and the relatively higher part of the frequency range of interest, respectively. Thereby feedback can be compared between frequency bands, and frequency bands comprising relatively little and/or relatively much feedback can be identified.

In an embodiment, the listening system comprises a howl detection unit adapted for detecting howl and providing an output indicative of the howl. In an embodiment, the howl detection unit detects howl based on an output from one of the (first and second) variable filters of the input signal paths to the FBC algorithm part of the adaptive FBC filter. In an embodiment, the listening system comprises an adaptation rate control unit adapted to control an adaptation rate of the adaptive FBC-filter based in an input from the howl detecting unit. In an embodiment, the howl detection unit is adapted to estimate the frequency location of acoustic feedback (e.g. based on the output of one of the first and second variable filters of the feedback cancellation system, cf. e.g. FIGS. 4*a-c*). In an embodiment, the output (and/or the input) of one of the first and second variable filters of the input signal paths to the FBC algorithm part of the adaptive FBC filter is used to estimate the amount of autocorrelation in the input signal to the FBC algorithm part of the adaptive FBC filter.

In a preferred embodiment, the system is adapted to use the electrical update signal to update the first and second variable filters in the relatively low frequency regions or bands. In a preferred embodiment, the system is adapted to use the electrical input signal from the first input transducer to update the first and second variable filters in at least one of the frequency regions or bands, and to use the electrical update signal to update the first and second variable filters in at least one of the (other) frequency regions or bands. In a preferred embodiment of a listening system according the invention, the system is adapted to use the electrical input signal from the first input transducer to update the first and second variable filters in the frequency regions with relatively little feedback, and to use the electrical update signal to update the variable filters in the frequency regions comprising relatively more feedback. In an embodiment, the system is adapted to determine 'relatively little' and 'relatively more feedback' on the basis of estimates of loop gain. In a preferred embodiment, the electrical input signal from the first input transducer of a first listening device is used to update the first and second variable filters of the first listening device in the frequency regions with relatively little feedback, whereas in the frequency regions, which are corrupted by feedback (comprising relatively much), the first and second variable filters of the first listening device are estimated in a second listening device, e.g. a contra lateral listening device, or at least based on the electrical update signal from a second input transducer located in the contra lateral listening device. In a preferred embodiment, the estimate (e.g. the filter coefficients or a corresponding transfer function) based on the electrical update signal from a second input transducer is communicated/transmitted (e.g. wirelessly) to the primary/first listening device comprising the first input transducer. Alternatively, the electrical update signal of the second input transducer of the second (contra lateral) listening device can be communicated to the primary/first listening device comprising the first input transducer and the estimate can be performed there. In the latter embodiment, the wireless link is adapted to provide a bandwidth sufficient for transmitting the audio signal itself (or a relevant frequency range thereof).

In an embodiment, the first and second variable filters are adapted to change with the spectrum of the direct part of the electrical input signal, e.g. following a predefined scheme. In an embodiment, the first and second variable filters are adapted to be periodically updated, e.g. with an update frequency in the range from 1 Hz to 1 kHz, such as between 50 Hz and 500 Hz, such as every 5 or 10 ms.

In a particular embodiment, the first and second variable filters comprise a common control part and separate (identical), respective, first and second variable filter parts, wherein the common control part is adapted to provide update information to modify the filtering function (transfer function) of the variable filter parts (thereby e.g. providing identical filter coefficients to the two variable filters and hence identical filtering functions).

In a particular embodiment, the control part of the first and second variable filters is based on linear predictive coding or adaptive filtering using the electrical update signal.

In an embodiment, the first and/or second variable filter is/are an adaptive filter, e.g. an adaptive whitening filter.

In an embodiment, the first and/or second variable filter is/are adapted to apply a gain which provides a substantially flat power spectral density (PSD) at the output of the variable filter(s).

In a particular embodiment, a listening device comprises a hearing instrument (HI).

In a binaural fitting comprising first and second hearing instruments, one for each ear of a user, the feedback cancellation system of the first HI can use first and second variable filters (e.g. whitening filters) that are estimated in the second HI (and vice versa). The estimation of the filter can e.g. (as shown in FIG. 2) be based on linear predictive coding (LPC) or adaptive filtering (e.g. using a least means squared (LMS) algorithm). The coefficients of the achieved model can then be transmitted from the second HI to the first HI (i.e. from the right to the left HI of FIG. 2, and vice versa). The transmission can be via a wired or a wireless, e.g. optical or electrical, communication. In an embodiment, the transmission can be performed periodically (e.g. every 1, 5, 10, 20, 50 or 100 ms) or when new coefficients are needed (e.g. as determined by a predefined change in the input spectrum). In each HI, the coefficients can be used to form a filter ($H_w$) that whitens the input signal to the FBC update algorithm part of the adaptive FBC filter. The whitening filter is used to filter both reference and error signal before they are used to update the adaptive FBC filter that provides an estimate of the acoustic feedback path.

A Method of Improving Feedback Cancellation in a Listening System:

It is intended that the features of the listening system described above, in the detailed description and in the claims can be combined with the method as described below. The method and its embodiments have the same advantages as the corresponding listening system described above.

In a further aspect, a method of improving feedback cancellation in a listening system is provided, the method comprises a) converting an input sound to an electrical input signal, the electrical input signal comprising a direct part and an acoustic feedback part;

b) converting an electrical output signal to an output sound;

c) providing an electrical forward path between the input and output signals;

d) providing an adaptive FBC filter arranged in parallel to the forward path for estimating acoustic feedback, the adaptive FBC filter comprising a variable FBC filter part and an FBC update algorithm part for updating the variable FBC filter part, the FBC update algorithm part comprising first and second FBC algorithm input signals, the first and second FBC algorithm input signals being influenced by the electrical input and output signals, respectively;

e) providing that the FBC algorithm input signal paths each comprises a variable filter; and f) providing an electrical update signal essentially consisting of said direct part of said electrical input signal; and g) providing that said variable filters are, at least partially, updated on the basis of said electrical update signal.

The term 'at least partially updated on the basis of said electrical update signal' is intended to include that a part of the frequency range (e.g. comprising relatively little amount of feedback) is updated based on or influenced by another signal (e.g. the electrical input signal).

In a particular embodiment, the electrical input signal is generated by a first input transducer and the electrical update signal is generated by a second input transducer spatially located relative to the first input transducer to provide that acoustic feedback (from the output transducer to the second input transducer) is minimized to provide that the electrical update signal essentially consists of the direct part of the electrical input signal or can be fully or partially reconstructed there from. In an embodiment, the update signal itself or filter coefficients based on the update signal is/are transmitted from the device wherein the second input transducer is located to the device where the first input transducer is located and used in the update process of the first and second variable filters. In an embodiment, only the filter coefficients are transmitted from one device to the other. In an embodiment, the transmission is performed according to a predefined scheme or is only performed when at least one filter coefficient has changed, e.g. more than 5-20% relative to its previous value.

In a particular embodiment, the electrical input signal from the first input transducer is used to estimate the variable filter in the frequency regions with relatively little feedback, and the electrical update signal is used to estimate the frequency regions comprising relatively more feedback.

In an embodiment, the variable filter is an adaptive filter, e.g. an adaptive whitening filter.

In an embodiment, at least some of the steps of the method are implemented in software (e.g. at least step d), such as at least steps d), e), g)). In an embodiment, a software program for running on a digital signal processor of a listening device according to the invention as defined above, in the detailed description and in the claims is provided. The software is adapted to implement at least some of the steps of the method the invention as defined above, in the detailed description and in the claims when executed on the digital signal processor of the listening device.

In a further aspect, a medium having instructions stored thereon is provided. The stored instructions, when executed, cause a signal processor of the listening system as described above, in the detailed description and in the claims to perform at least some of the steps of the method as described above, in the detailed description and in the claims. Preferably at least one of steps, e.g. at least step d), such as at least steps d), e), g) of the method is included in the instructions. In an embodiment, the medium comprises a non-volatile memory of the listening system. In an embodiment, the medium comprises a volatile memory of the listening system.

Use of a Listening System:

In a further aspect, use of a listening system as described above in the section 'A listening system', in the detailed description and in the claims is provided.

In a particular embodiment, use of a listening system according to the invention in a hearing aid system or a head set or an ear phone system or an ear active plug system is provided.

A Listening System Comprising a Howl Detection Unit:

In a further aspect, a listening system comprising a howl detection unit is provided. The listening system comprises a first input transducer for converting an input sound to an electrical input signal, the electrical input signal comprising a direct part and an acoustic feedback part, an output transducer for converting an electrical output signal to an output sound, a forward path being defined between the input and output transducer and comprising a signal processing unit, a feedback cancellation system for estimating acoustic feedback comprising an adaptive FBC filter arranged in parallel to the forward path, the adaptive FBC filter comprising a variable FBC filter part and an FBC update algorithm part for updating the variable FBC filter part, the FBC update algorithm part comprising first and second FBC algorithm input signals influenced by the electrical input and output signals, respectively. The feedback cancellation system further comprises an adaptive whitening filter, a howl detection unit and an electrical update signal essentially consisting of said direct part of said electrical input signal, the listening system being adapted to provide that the filter coefficients of said adaptive whitening filter are adapted to be updated on the basis of said electrical update signal, and that howl detection in the howl detection unit is based on the output of the whitening filter.

It is intended that the structural features of the listening system described above (under the heading A listening system), in the detailed description of 'mode(s) for carrying out the invention' and in the claims can be combined with the listening system comprising a howl detection unit, where appropriate.

Further objects of the invention are achieved by the embodiments defined in the dependent claims and in the detailed description of the invention.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1A:
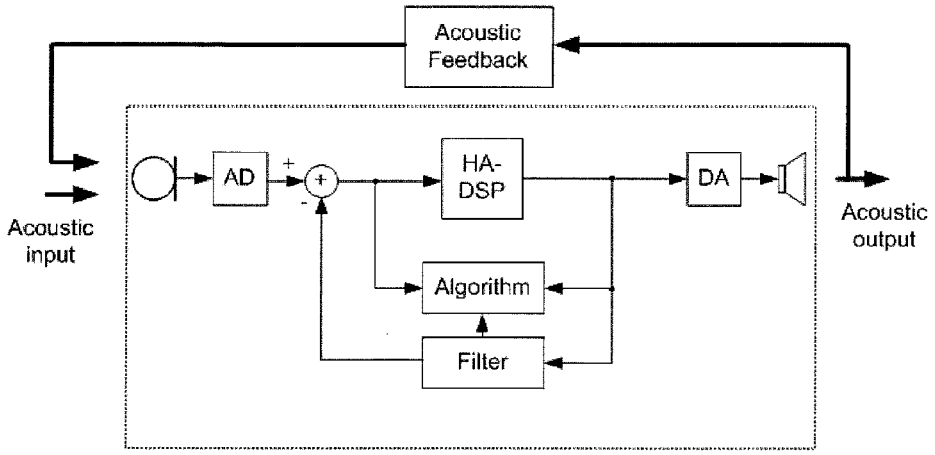
Fig. 1a BACKGROUND ART
FIG. 1*a* shows a block diagram of a listening device comprising an adaptive FBC filter for minimizing acoustical feedback.

FIG. 1*a* illustrates the basic components of a hearing instrument, the forward path, an (unintentional) acoustical feedback path and an electrical feedback cancellation path for reducing or cancelling acoustic feedback. The forward path comprises an input transducer for receiving an acoustic input from the environment, an analogue to digital converter (AD-converter), a digital signal processing part HA-DSP for adapting the signal to the needs of a wearer of the hearing aid, a digital to analogue converter (DA-converter) and an output transducer for generating an acoustic output to the wearer of the hearing aid. An (external, unintentional) Acoustical Feedback path from the output transducer to the input transducer is indicated. The electrical feedback cancellation path comprises an adaptive filter (Algorithm, Filter), whose filtering function (Filter) is controlled by a prediction error algorithm (Algorithm), e.g. an LMS (Least Means Squared) algorithm, in order to predict and preferably cancel the part of the microphone signal that is caused by feedback from the receiver of the hearing aid (as indicated in FIG. 1 by bold arrow Acoustic Feedback). The adaptive filter (in FIG. 1*a* shown to comprise a 'Filter' part and a prediction error 'Algorithm' part) is aimed at providing a good estimate of the external feedback path from the DA to the AD. The prediction error algorithm uses a reference signal (here the output signal from the signal processor HA-DSP) together with the (feedback corrected) input signal from the microphone (the error signal) to find the setting of the adaptive filter that minimizes the prediction error when the reference signal is applied to the adaptive filter. The acoustic feedback is cancelled (or at least reduced by subtracting (cf. SUM-unit '+' in FIG. 1) the estimate of the acoustic feedback path provided by the output of the Filter part of the adaptive filter from the input signal from the microphone comprising acoustic feedback (output of AD-converter in FIG. 1) to provide the feedback corrected input signal (Error signal in FIG. 1). The forward path (alternatively termed 'signal path') of the hearing aid comprises signal processing (termed 'HA-DSP' in FIG. 1*a*) to adjust the signal (incl. gain) to the possibly impaired hearing of the user. The dotted rectangle indicates that the enclosed blocks of the listening device are located in the same physical body (in the depicted embodiment). Alternatively, the microphone and processing unit and feedback cancellation system can be housed in one physical body and the output transducer in a second physical body, the first and second physical bodies being in communication with each other. Other divisions of the listening device in separate physical bodies can be envisaged.

Figure 1B:
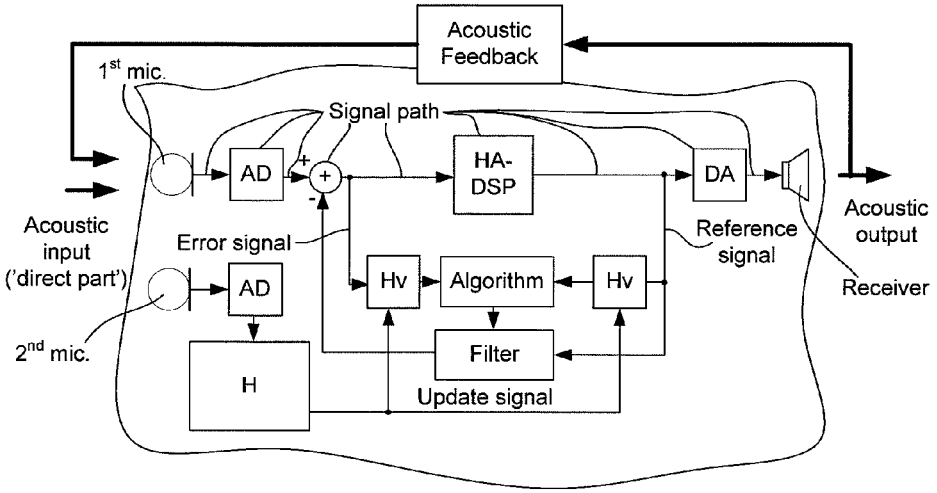
FIG. 1*b* shows a block diagram of a listening device according to a first embodiment of the present invention.
Figure 1C:
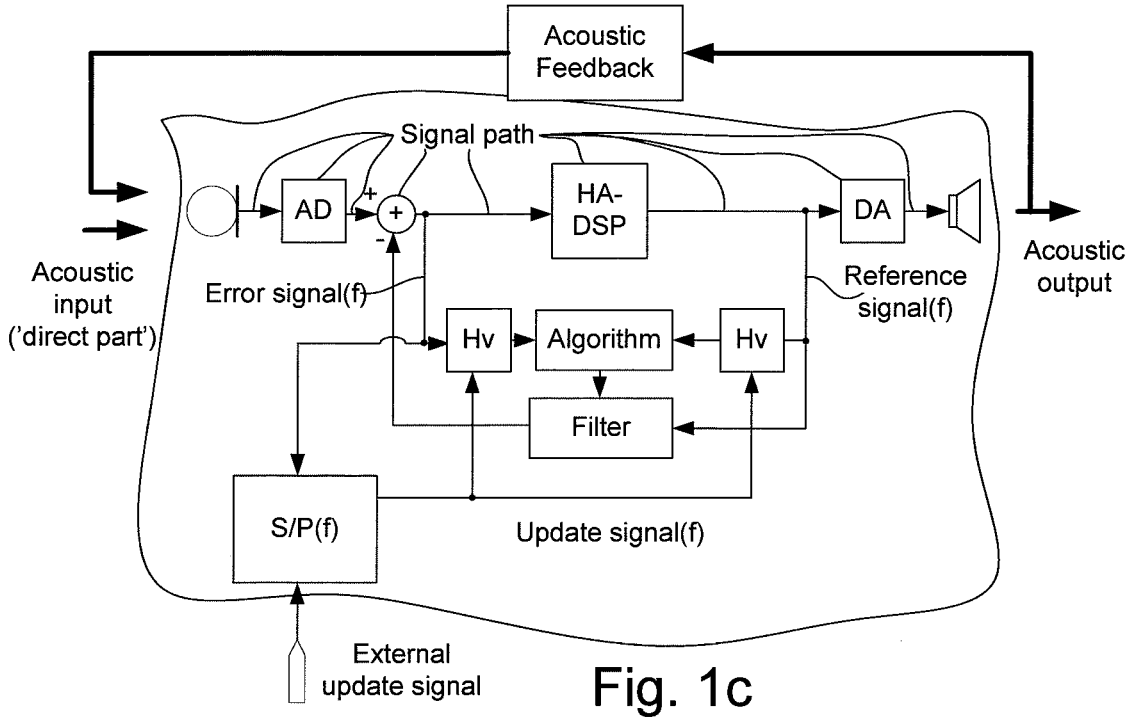
FIG. 1*c* shows a block diagram of a listening device according to a second embodiment of the present invention.

FIG. 1*b* shows a block diagram of essential electrical parts of a first embodiment of a listening device according to the invention. In addition to the parts shown in FIG. 1*a*, the embodiment in FIG. 1*b* comprises first and second variable filters $H_v$ in the input paths of the FBC update algorithm part of the adaptive FBC filter. In FIGS. 1*b* (and 1*c*), the first input transducer is referred to as $1^{st}$ mic., and the output transducer is referred to as Receiver. An input to the first variable filter is the error signal (feedback corrected input signal) and the output of the first variable filter is connected to the FBC update algorithm part. An input to the second variable filter is the reference signal (output signal) and the output of the second variable filter is connected to the FBC update algorithm part. The transfer characteristics of the variable filters are determined and updated by an Update signal. The update signal is adapted to comprise the direct part of the input signal, preferably without the acoustic feedback part from the receiver to the microphone ($1^{st}$ mic.), or at least in a smaller proportion. In the embodiments of FIGS. 1*b* and 1*c*, the update signal is EITHER generated within the physical body of the listening device comprising the input transducer and the processing unit (HA-DSP), e.g. by another microphone ($2^{nd}$ mic. in FIG. 1*b*) than that ($1^{st}$ mic. in FIG. 1*b*) shown in the signal path of FIG. 1*b*, OR generated in another device (cf. External update signal in FIG. 1*c*). The waved frame in FIGS. 1*b* and 1*c* indicates that the enclosed blocks of the listening device are located in the same physical body (in the depicted embodiments). In the embodiment of FIG. 1*b*, the electric input signal from the second input transducer ($2^{nd}$ mic.) is fed to an analogue to digital converter (AD), whose output is fed to an update signal processing unit (H) for determining the update signal, e.g. by calculating filter coefficients for the first and second variable filters (Hv). The filter coefficients are fed to both variable filters $H_v$ by signal Update signal.

Figure 2:
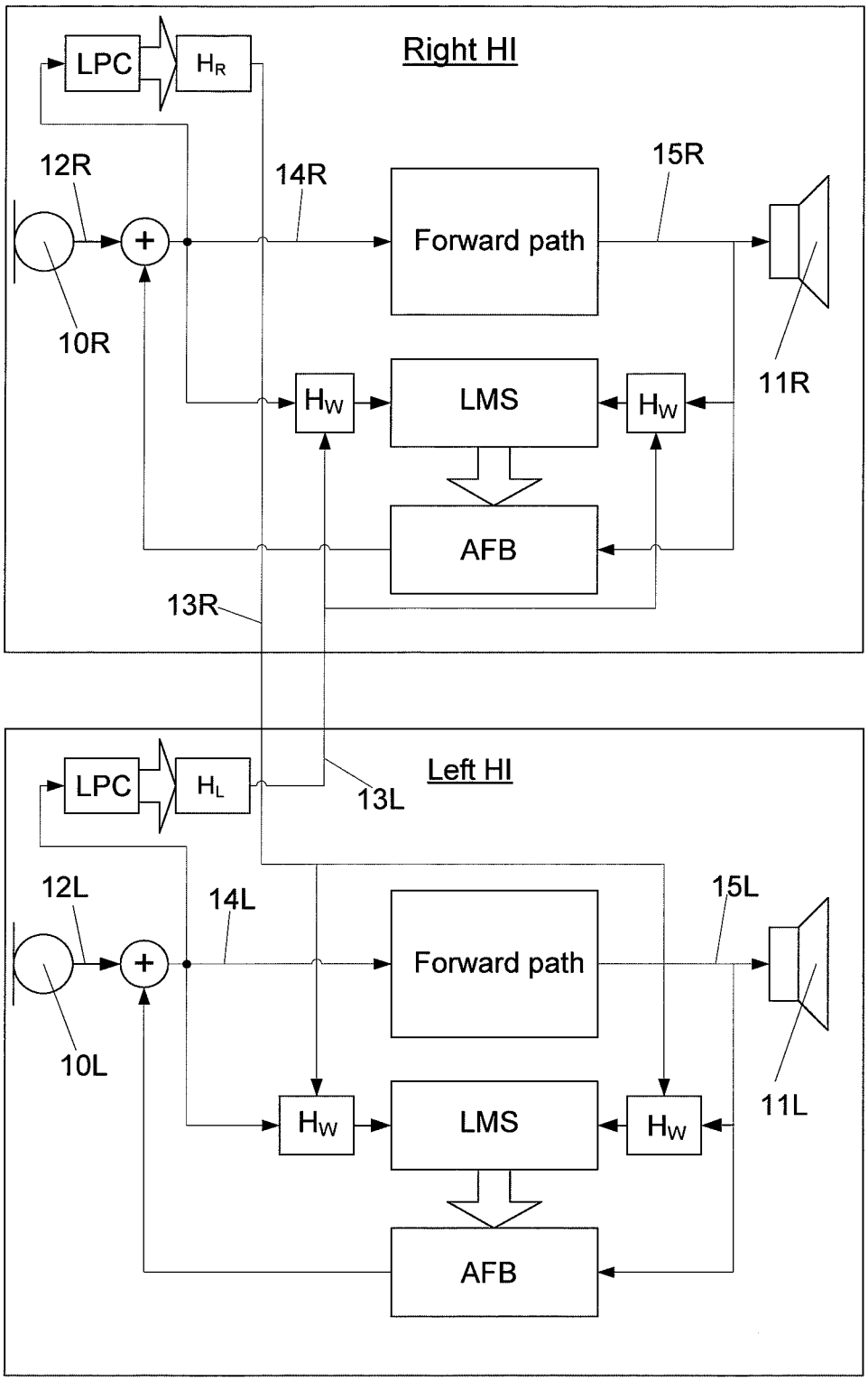
FIG. 2 shows a block diagram of a listening system according to an embodiment of the present invention, the listening system comprising two physically separate listening devices, here in the form of left and right hearing instruments.

In the embodiment of FIG. 1*c*, a first update signal (termed the External update signal in FIG. 1*c*) is generated in another physical body than that housing the first input transducer ($1^{st}$ mic.) and the output transducer (Receiver). An example thereof is illustrated in FIG. 2.

In the embodiment of FIG. 1*c*, the electric input signal from the first input transducer is assumed to be split in a number of frequency bands (e.g. in a filter bank forming part of the AD-converter), which are processed separately. The splitting in frequency bands is indicated in FIG. 1*c* in the signal references being functions of frequency f (Reference signal(f), Update signal(f), Error signal(f)). This allows the first and second variable filters Hv to be updated by different update signals in different frequency ranges or bands. The selection and processing unit (S/P(f)) is adapted to select (and optionally process) the update signal to be used in a given frequency band according to predefined criteria. A frequency dependent selection between a first update signal generated by the first input transducer (here $1^{st}$ mic.) and a second update signal (here the External update signal generated in another device) can be made by the S/P(f)-unit. Preferably, criteria include basing the update of the first and second variable filters in the relatively low frequency regions or bands on the electric update signal (here the External update signal) and the update of the first and second variable filters in the relatively high frequency regions or bands on the electric signal from the first input transducer (here the feedback corrected Error signal(f)). The relatively low frequency regions or bands can e.g. include frequencies below 1.5 kHz, such as below 1 kHz. This has the advantage of reducing the requirements to the (possibly wireless) transmission from the other device.

In an embodiment, wherein the listening system comprises first and second physically separate listening devices, e.g. each adapted to be located at or in an ear canal of a wearer, i.e. on opposite sides of a wearer's head, the fact that the contra lateral device (e.g. a hearing instrument), here e.g. the second device, receives an input signal that is not (or only marginally) corrupted by the acoustic feedback of the first device is used in the estimation of the transfer function of the variable (e.g. whitening) filters of the first device (and vice versa) thereby providing an improved performance. The whitening filter can thus be estimated in the contra lateral (second) device and a resulting signal (representative of the transfer function of the whitening filters, e.g. corresponding filter coefficients) transmitted to the first device, where it can be used to update the two whitening filters to filter the signals used to update the anti feedback system.

In an embodiment, a listening device comprises a hearing instrument. The scheme of the invention can e.g. be used in a binaural hearing instrument fitting or alternatively in a monaural fitting, if there is some external device coupled to the hearing aid (e.g. a mobile telephone, or an audio selection device, cf. e.g. EP 1 460 769 A1, or a remote control device, cf. e.g. U.S. Pat. No. 5,202,927) and if the external device comprises a 'cleaner' version of the audio signal in question (without or with a smaller amount of acoustic feedback from the receiver of the hearing instrument), e.g. generated by a separate microphone.

FIG. 2 shows a block diagram of a listening system according to an embodiment of the present invention, the listening system comprising two physically separate listening devices, here in the form of left and right hearing instruments.

FIG. 2 shows an embodiment of a listening system according to the invention in the form of a binaural hearing aid system with an anti feedback system. Each hearing instrument (Right-HI and Left-HI) comprises a Forward path (e.g. comprising signal processing) between a microphone 10 (10R, 10L, of the right and left instrument, respectively) and a receiver 11 (11R, 11L, respectively) and a feedback cancellation system comprising an adaptive FBC filter (LMS, AFB) arranged in an electrical feedback path. Each microphone converts an acoustic input signal to an electrical input signal 12 (12R, 12L). The input signal consists of a direct part and an acoustical feedback part. The algorithm part (LMS) of the adaptive filter of the anti feedback system uses the electrical output signal 15 (15R, 15L) as a reference and the electrical input signal after feedback cancellation 14 (14R, 14L) as error signal when the variable filter part (AFB) of the adaptive feedback cancellation filter is updated (i.e. the direct method). The reference signal 15 and error signal 14 are each filtered through a whitening filter ($H_w$) before they are used in the algorithm part (LMS) of the adaptive filter. Both whitening filters ($H_w$) of a HI are FIR-filters (or alternatively, IIR-filters) and are (via signals 13 (13R, 13L)) provided with the same coefficients or characteristics (the coefficients are here shown to be determined by LPC units (LPC) and respective processing blocks $H_R$ and $H_L$ of the contra lateral hearing instrument, $H_R$, $H_L$ for the right and left instruments, respectively). The coefficients for the whitening filters of a given HI are computed in the contra lateral HI based on the feedback corrected input signal of that (contra lateral) HI, and new coefficients are e.g. transmitted according to a predetermined scheme, e.g. periodically, e.g. every 5-20 ms. Electrical input signal 12L of the left HI is termed 'electrical update signal' 12L in connection with its use for calculating update filter coefficients of whitening filters of the right HI (and vice versa). Wireless communication between the two hearing instruments of the system (cf. signals 13 (13R, 13L)), e.g. based on inductive communication or RF (radiated fields) communication, is arranged.

An advantage of the embodiment of FIG. 2 is that because the microphone-signal of the left HI (electrical update signal 12L) is used to update the whitening filters ($H_w$) of the right HI (and vice versa), it is likely not to be corrupted by the acoustic feedback (of the right HI) that is to be cancelled.

If there is a desired tone in the input signal (e.g. music), it will be present in both hearing instruments. The whitening filter ($H_w$) will then attenuate this tone and it will not affect the update when the acoustic feedback is estimated. This means that the anti feedback system ($H_w$, LMS, AFB) will not affect the tone and artefacts that may otherwise occur can be avoided.

If there is a tone due to feedback oscillation, it will not be present (or at least attenuated substantially) in the other hearing instrument. Hence, the whitening filter ($H_w$) will not attenuate the tone. The update of the anti feedback filter (AFB) can then perceive the tone and it will give a fast and accurate adaptation at this frequency, as desired. This effect can advantageously (and more generally) be used to detect acoustic feedback (and/or the amount of autocorrelation in the input signal), as discussed below in connection with FIGS. 4*a-c*.

The whitening filter ($H_w$) could also be estimated in some other external device, e.g. a mobile telephone or other communications device comprising a microphone located in the vicinity of the hearing instrument (e.g. within 1.5 m) and with which the hearing instrument(s) can communicate. The other communications device can e.g. be an audio selection device, wherein an audio signal can be selected among a number of audio signals received (possibly including a signal from a mobile telephone or from a radio or music player, e.g. an MP3-player or the like) and then forwarded to the hearing instrument by a wired or wireless transmission (e.g. inductively or radiated, e.g. FM or according to a digital standard, e.g. Bluetooth).

In the following, the determination of the coefficients of the whitening filters by an LMS algorithm is described. In the contra lateral HI, the following computations are used to compute the coefficients with an adaptive LMS that try to find a one step ahead (or forward) predictor of the input signal.

$$\hat{y}=-a_1*y(t-1)-a_2*y(t-2)-\ldots-a_{Na}*y(t-Na)$$

$$e(t)=y(t)-\hat{y}(t)$$

where $$[a_1\ a_2\ldots a_{Na}](t+1)=[a_1\ a_2\ldots a_{Na}](t)+m_y*e(t)[-y(t-1)-y(t-2)\ldots-y(t-Na)]$$

y(t) is the signal after cancellation $\hat{y}(t)$ is a prediction of y(t)

e(t) is the error of the prediction (forward predictive error)

$m_y$ is a time constant that controls the adaptation speed

Na is the number of order/coefficients of the whitening filter.

The coefficients $a_1$ to $a_{Na}$ are sent from the contra lateral (or second) hearing instrument to the first hearing instrument, where the whitening filter is formed as a FIR-filter with the following coefficients: $[1\ a_1\ a_2\ldots a_{Na}]$.

In the same way that the contra lateral hearing instrument computes the whitening filter for the first hearing instrument, the first hearing instrument computes the whitening filter for the contra lateral (second) hearing instrument.

Adaptive filters and appropriate algorithms are e.g. described in Ali H. Sayed, *Fundamentals of Adaptive Filtering*, John Wiley & Sons, 2003, ISBN 0-471-46126-1, cf. e.g. chapter 5 on *Stochastic-Gradient Algorithms*, pages 212-280, or Simon Haykin, *Adaptive Filter Theory*, Prentice Hall, 3rd edition, 1996, ISBN 0-13-322760-X (referred to as [Haykin]), cf. e.g. Part 3 on *Linear Adaptive Filtering*, chapters 8-17, pages 338-770. Linear predictive filters are e.g. discussed in [Haykin], chapter 6, pages 241-301.

Figure 3A:
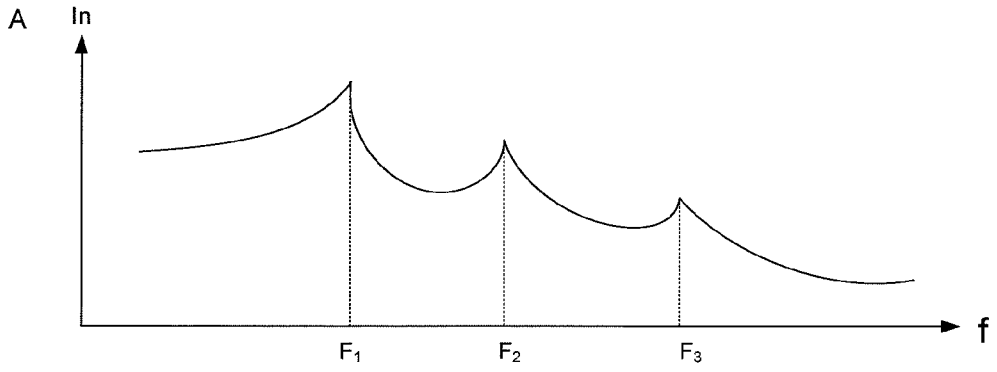
FIGS. 3*a-c* show a schematic illustration of a frequency spectrum of (the direct part of) an electrical input signal to an adaptive whitening filter at a given time (FIG. 3*a*) and an ideal transfer function of the whitening filter (FIG. 3*b*), and the (idealized) resulting output from the whitening filter, which is used as an input to the FBC update algorithm part of the adaptive FBC filter (FIG. 3*c*)
Figure 3B:
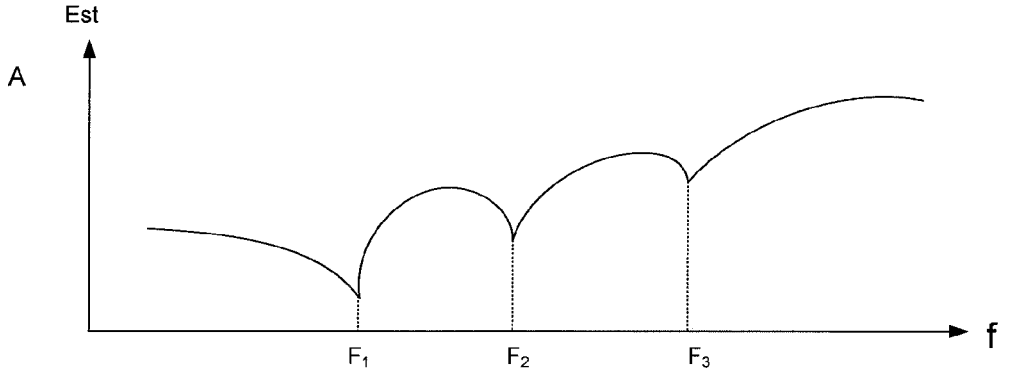
Figure 3C:
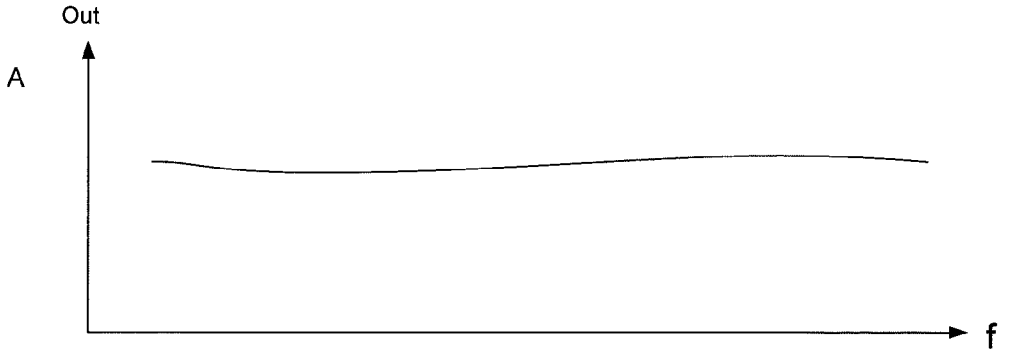

FIGS. 3*a-c* show a schematic illustration of a frequency spectrum of (the direct part of) an electrical input signal to an adaptive whitening filter at a given time (FIG. 3*a*) and an ideal transfer function of the whitening filter (FIG. 3*b*), and the (idealized) resulting output from the whitening filter, which is used as an input to the FBC update algorithm part of the adaptive FBC filter (FIG. 3*c*).

Figure 4A:
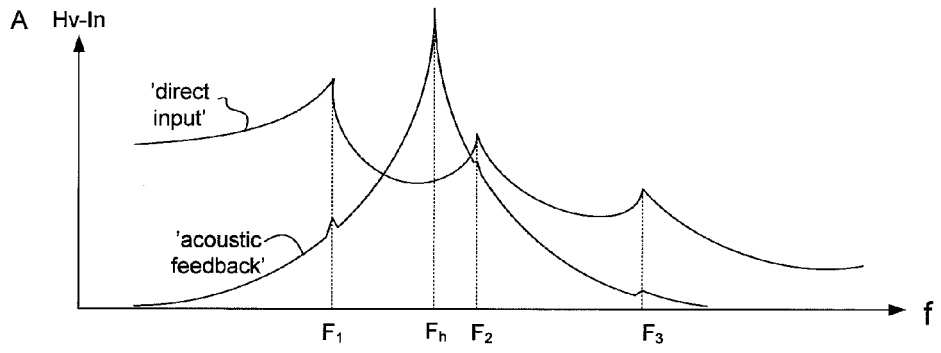
FIGS. 4*a-c* show a schematic illustration of a frequency spectrum of an electrical input signal (including acoustic feedback) to an adaptive whitening filter at a given time (FIG. 4*a*) and an ideal transfer function of the whitening filter (FIG. 4*b*), and the (idealized) resulting output from the whitening filter, which can used to detect acoustic feedback (FIG. 4*c*), and FIG. 5 schematically shows a listening system according to an embodiment of the invention utilizing the scheme depicted in FIGS. 4*a-c* for howl-detection.
Figure 4B:
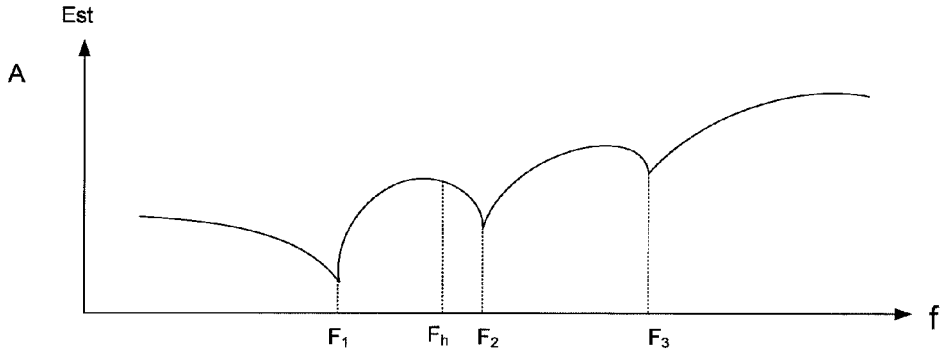
Figure 4C:
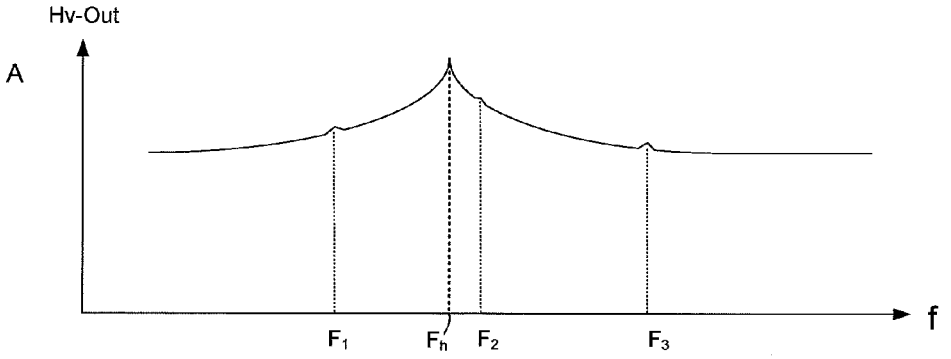

FIG. 4*a* is a schematic illustration of a frequency spectrum of an electrical input signal comprising the target signal ('direct part') and feedback signal (here) comprising a howl component between formant frequencies $F_1$ and $F_2$ ('acoustic feedback') to an adaptive whitening filter $H_v$ at a given time. The input signal is the signal resulting from the sum of the two depicted signals ('direct part' and 'acoustic feedback'). FIG. 4*b* shows an ideal transfer function of the whitening filter, which (ideally) is not influenced by the acoustic feedback signal. FIG. 4*c* shows the (idealized) resulting output from the whitening filter, which can be used to detect acoustic feedback around frequency $F_h$. Such detection can e.g. be used as an input to adjustment of the adaptation rate (μ) of an adaptive feedback cancellation system, e.g. to increase the adaptation rate (at least) in a frequency range or band around the detected howl-frequency $F_h$ and to decrease the adaptation rate, when no howl components are detected.

Figure 5:
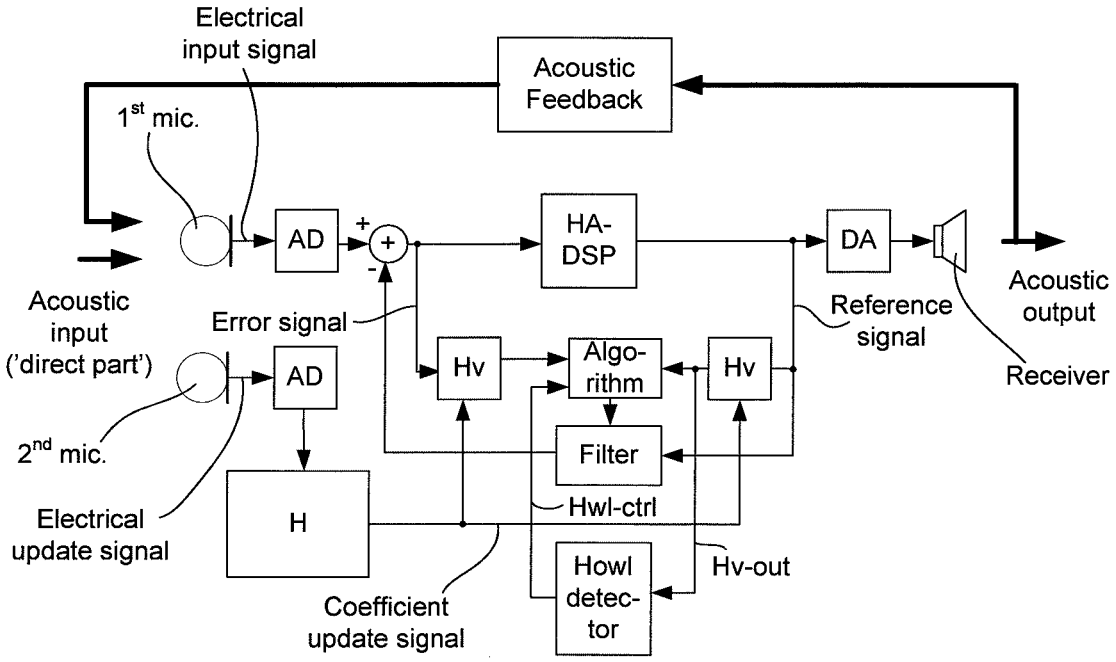

An embodiment of a listening system according to the invention utilizing such a scheme for howl-detection is schematically shown in FIG. 5. The embodiment of FIG. 5 comprises the same components as the embodiment of FIG. 1*b* described above. In addition, the listening device comprises howl detector unit (Howl detector in FIG. 5), which receives as an input the whitened output Hv-out of variable filter Hv (here shown as the output from the variable filter Hv receiving input from the output side of the forward path (Reference signal), but the input to the howl detector unit might just as well come from the variable filter receiving its input from the input side of the forward path (Error signal)). The howl detector is adapted to detect a peak in its input Hv-out and to generate a control signal Hwl-ctrl, which is fed to the Algorithm part of the FBC filter. The control signal Hwl-ctrl is intended for at least influencing a step size μ of the algorithm of the FBC-filter (e.g. to increase the adaptation speed of the FBC filter in case a howl is detected). In an embodiment, the location in frequency of the howl is detected by the howl detector, so that a particular frequency band or bands can be selectively processed as regards cancellation of howl (by making the control signal Hwl-ctrl frequency dependent). The Electrical input signal is picked up by a first input transducer of the listening device ($1^{st}$ mic.). The Electrical update signal picked up by the $2^{nd}$ input transducer ($2^{nd}$ mic. In FIG. 5) can be a signal from a microphone in the same device as the $1^{st}$ microphone ($1^{st}$ mic.) or it can be a signal picked up by a microphone located in another device. The Electrical update signal itself or preferably the filter coefficients (or changes to the filter coefficients) for updating the variable filters Hv (signal Coefficient update signal in FIG. 5) can e.g. be transmitted to the listening device via a wireless link.

Figure 6:
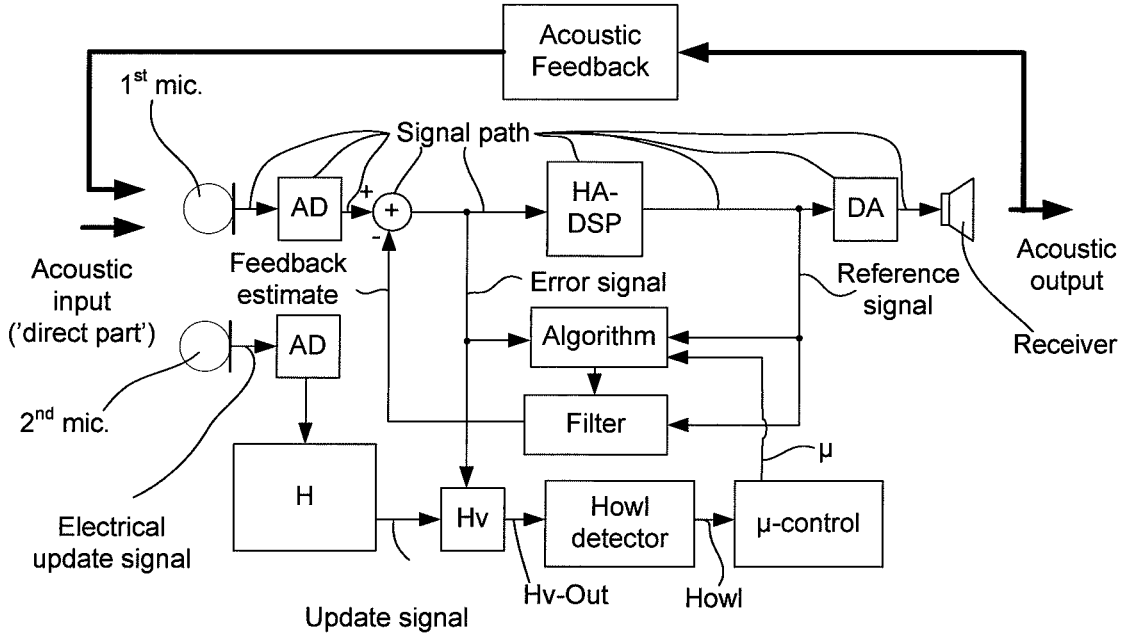
FIG. 6 schematically shows a listening system comprising a howl detector utilizing the scheme depicted in FIGS. 4*a-c* for howl-detection.

FIG. 6 schematically shows a listening system comprising a howl detection unit utilizing the scheme depicted in FIGS. 4*a-c* for howl-detection. The embodiment of a listening system comprising a howl detection unit shown in FIG. 5 comprises basically the same components as the listening device of FIG. 1*b* described above, except that the input paths of the FBC update algorithm part (Algorithm in FIG. 6) of the adaptive FBC filter (Algorithm, Filter in FIG. 6) does NOT (necessarily) comprise first and second variable filters $H_y$. On the other hand, the listening system comprising a howl detection unit additionally comprises a variable filter Hv receiving an input from a signal derived from the Electrical input signal of the first input transducer ($1^{st}$ mic.), e.g., as shown here, the feedback corrected input signal (Error signal) or the output signal (Reference signal). The Electrical update signal from the $2^{nd}$ input transducer ($2^{nd}$ mic.) is used to generate filter coefficients for the variable filter Hv to generate a whitened output Hv-Out of the variable filter. The listening system additionally comprises a howl detector unit (Howl detector in FIG. 6), which receives as an input the whitened output Hv-Out of variable filter Hv, and an adaptation rate control unit (p-control in FIG. 6) for controlling the adaptation rate of the adaptive FBC filter, e.g. by controlling the step-size of the algorithm used in the Algorithm part of the FBC filter. The output signal μ of the adaptation rate control unit is fed to the Algorithm part of the FBC filter. The Howl detector is adapted to detect a peak in its input Hv-Out and to generate a control signal Howl indicative of the presence of a howl (peak) in Hv-Out. In an embodiment, the Howl detector is adapted to detect the amount of autocorrelation present in the input signal. The control signal Howl is fed to the adaptation rate control unit (μ-control). In an embodiment, the location in frequency of the howl is detected by the Howl detector, so that a particular frequency band or bands can be selectively processed as regards cancellation of howl (by making the control signal μ frequency dependent). The electrical input signal possibly containing Acoustic Feedback from a Receiver of the listening device is picked up by a first input transducer located in the listening device ($1^{st}$ mic.). The Electrical update signal, on the other hand, picked up by the $2^{nd}$ input transducer ($2^{nd}$ mic. In FIG. 6) can be a signal from a microphone in the same device as the $1^{st}$ microphone ($1^{st}$ mic.) or it can be a signal picked up by a microphone located in another device. The Electrical update signal itself or preferably the filter coefficients (or changes to the filter coefficients) for updating the variable filter Hv (signal Update signal in FIG. 6) can be transmitted to the listening device via a wired connection or a wireless link. A feedback oscillation detector, which can be used in the howl detection unit of the present invention, is e.g. described in WO 01/006746 A2.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims. The invention has been exemplified in connection with a hearing aid system, but it may as well be useful in connection with other listening devices comprising signal processing, such as for example, active ear plugs, headphones, head sets, etc.

REFERENCES

Spriet et al., Adaptive feedback cancellation in hearing aids with linear prediction of the desired signal, IEEE Transactions on Signal Processing, Volume 53, Issue 10, October 2005, Pages 3749-3763

EP 1 460 769 A1 (PHONAK) 22, Sep. 2004

U.S. Pat. No. 5,202,927 (TØPHOLM & WESTERMANN) 13, April 1993

Ali H. Sayed, Fundamentals of Adaptive Filtering, John Wiley & Sons, 2003, ISBN 0-471-46126-1

Simon Haykin, Adaptive Filter Theory, Prentice Hall, $3^{rd}$ edition, 1996, ISBN 0-13-322760-X.

WO 01/006746 A2 (OTICON) 25, Jan. 2001

The invention claimed is:

1. A listening device, comprising:

an input transducer for converting an input sound to an electrical input signal, the electrical input signal including a direct part and an acoustic feedback part;

an output transducer for converting an electrical output signal to an output sound, a forward path being defined between the input transducer and the output transducer;

a signal processing unit; and a feedback cancellation system for estimating acoustic feedback, the feedback cancellation system including an adaptive FBC filter arranged in parallel to the forward path, the adaptive FBC filter including a variable FBC filter part, and an FBC update algorithm part for updating the variable FBC filter part, the FBC update algorithm part receiving first and second FBC algorithm input signals influenced by the electrical input and the electrical output signals, respectively, through a first and a second FBC update algorithm input signal path, respectively, an adaptive whitening filter, and a howl detection unit, wherein a detection performed by the howl detection unit is based on output of the adaptive whitening filter, the feedback cancellation system receives an electrical update signal essentially consisting of said direct part of said electrical input signal, and coefficients of said adaptive whitening filter are based on said electrical update signal.

2. The listening device according to claim 1, further comprising:

an adaptation rate controller configured to control an adaptation rate of the adaptive FBC filter based on a detection signal output by the howl detection unit and received as input by the adaptation rate controller.

3. The listening device according to claim 1, wherein the howl detection unit is further configured to estimate a frequency location of the acoustic feedback.

4. The listening device according to claim 1, wherein the first and second FBC update algorithm input signal paths including a first variable filter and a second variable filter, respectively.

5. The listening device according to claim 4, wherein the first variable filter or the second variable filter comprises said whitening filter.

6. The listening device according to claim 4, wherein the howl detection unit is configured to estimate the frequency location of the acoustic feedback based on an output of at least one of the first variable filter and the second variable filter.

7. The listening device according to claim 4, wherein the feedback cancellation system is configured to estimate an amount of autocorrelation in the input signal based on an output of the first variable filter or of an output of the second variable filter.

8. The listening device according to claim 4, wherein the feedback cancellation system is configured to estimate an amount of autocorrelation in the input signal based on an input of the first variable filter or of an input of the second variable filter.

9. The listening device according to claim 1, comprising at least one of:

a hearing aid, a hearing instrument, a headset, a head phone, and an active ear-plug.

10. A method of improving feedback cancellation in a listening device system, the method comprising:

converting an input sound to an electrical input signal by an input transducer, the electrical input signal including a direct part and an acoustic feedback part;

converting an electrical output signal to an output sound by an output transducer;

providing an electrical forward path between the input and output signals comprising a processing function to modify the electrical input signal;

providing an adaptive feedback cancellation filtering function for estimating acoustic feedback from said output sound to said input sound, the adaptive feedback cancellation filtering function including a variable FBC filter part and an FBC update algorithm part for updating the variable FBC filter part, the FBC update algorithm part receiving first and second FBC algorithm inputs, the first and second FBC algorithm inputs being influenced by the electrical input and the electrical output signals, respectively, through a first and a second FBC update algorithm input paths, respectively;

detecting howl with a howl detector based on output of an adaptive whitening filter of the listening device system;

producing an electrical update signal essentially consisting of said direct part of said electrical input signal by a second input transducer housed separately from said input transducer; and providing that coefficients of said adaptive whitening filter are based on said electrical update signal.

11. The method according to claim 10, further comprising:

controlling an adaptation rate of the adaptive feedback cancellation filtering function based on a detection signal output by the howl detector.

12. The method according to claim 10, further comprising:

estimating a frequency location of the acoustic feedback part by the howl detector.

13. The method according to claim 10, further comprising:

providing that the FBC update algorithm inputs each comprises a variable filter function.

14. The method according to claim 13, wherein said variable filter function performs the whitening filter function of said detecting howl step.

15. The method according to claim 13, wherein said estimating is based on an output of at least one of the variable filter functions.

16. The method according to claim 13, further comprising:

estimating an amount of autocorrelation in the input signal based on an output of one of the variable filter functions.

17. The method according to claim 13, further comprising:

estimating an amount of autocorrelation in the input signal based on an input of one of the variable filter functions.

18. The method according to claim 10, wherein the listening device system includes a pair of hearing aids, a pair of headphones, a pair of active ear-plugs, or combinations thereof.

* * * * *